US007014439B2

(12) United States Patent
Kano et al.

(10) Patent No.: US 7,014,439 B2
(45) Date of Patent: Mar. 21, 2006

(54) VANE PUMP HAVING VOLUME VARIABLE PUMP CHAMBERS COMMUNICATABLE WITH INLET AND OUTLET

(75) Inventors: Masao Kano, Gamagori (JP); Yoshichika Yamada, Kuwana-gun (JP); Mitsuyuki Kobayashi, Gamagori (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/628,480

(22) Filed: Jul. 29, 2003

(65) Prior Publication Data

US 2004/0022659 A1 Feb. 5, 2004

(30) Foreign Application Priority Data

Jul. 29, 2002 (JP) ..... 2002-219578

(51) Int. Cl.
*F04C 2/00* (2006.01)
*F03C 2/00* (2006.01)

(52) U.S. Cl. ..... 418/259; 418/81; 418/132; 418/133

(58) Field of Classification Search ..... 418/259, 418/266–268, 132, 75–77, 79, 81
See application file for complete search history.

(56) References Cited

U.S. PATENT DOCUMENTS 2,387,761 A * 10/1945 Kendrick ..... 418/81
3,194,168 A * 7/1965 Rosaen ..... 418/132
3,565,550 A * 2/1971 Bellmer ..... 418/81
5,380,178 A * 1/1995 Noah ..... 418/133

FOREIGN PATENT DOCUMENTS

| | | | |
|---|---|---|---|
| DE | 3135255 A | * | 3/1983 |
| GB | 2015084 | | 2/1979 |
| JP | 54071413 | | 6/1979 |
| JP | 57000390 A | * | 1/1982 |
| JP | 58051288 | | 3/1983 |
| JP | 58-177576 | | 11/1983 |
| JP | 63098493 | | 6/1988 |
| JP | 1170783 | | 7/1989 |
| JP | 02108881 A | * | 4/1990 |
| JP | 7049094 | | 2/1995 |

* cited by examiner

*Primary Examiner*—Theresa Trieu
(74) *Attorney, Agent, or Firm*—Nixon & Vanderhye PC

(57) ABSTRACT

In a vane pump, a rotor chamber is defined within a housing that includes a ring and first and second plates. An inlet is communicated with the rotor chamber through an intake groove, and an outlet is communicated with the rotor chamber through a discharge groove. A rotor, which has a plurality of radially reciprocable vanes, is rotatably received in the rotor chamber, and a plurality of volume variable pump chambers is defined by the vanes between an inner peripheral wall surface of the housing and an outer peripheral surface of the rotor. The discharge groove includes a first end and a second end, and the second end is positioned away from the first end in the rotational direction of the rotor. The outlet extends directly from the second end of the discharge groove.

12 Claims, 7 Drawing Sheets

VANE PUMP HAVING VOLUME VARIABLE PUMP CHAMBERS COMMUNICATABLE WITH INLET AND OUTLET

CROSS REFERENCE TO RELATED APPLICATION

This application is based on and incorporates herein by reference Japanese Patent Application No. 2002-219578 filed on Jul. 29, 2003.

BACKGROUND OF THE INVENTION

1. Field of the Invention

The present invention relates to a vane pump having volume variable pump chambers communicatable with an inlet and an outlet.

2. Description of Related Art

FIGS. 20–22 show a previously proposed vane pump 100. The vane pump 100 includes a ring 130, which is interposed between first and second plates 110, 120. A rotor chamber is defined radially inward of the ring 130. A rotor 150, which supports a plurality of radially reciprocable vanes 140, is rotatably supported in the rotor chamber in such a manner that a rotational axis of the rotor 150 is displaced from the center of the rotor chamber. A plurality of volume variable pump chambers 160 is defined by the vanes 140 between an inner peripheral wall surface of the ring 130 and an outer peripheral wall surface of the rotor 150. A volume of each pump chamber 160 changes when the rotor 150 is rotated.

When the rotational axis of the rotor 150 is oriented in the vertical direction (a top-bottom direction in FIG. 20) in a manner shown in FIG. 20, the second plate 120 is placed below the ring 130. The second plate 120 includes an inlet 180 and an outlet 200. The inlet 180 is communicated with a corresponding one of the pump chambers 160 through an intake groove 170 recessed in the second plate 120, and the outlet 200 is communicated with a corresponding one of the pump chambers 160 through a discharge groove 190 recessed in the second plate 120.

The intake groove 170 is provided in a volume increasing region where the volume of each corresponding pump chamber 160 increases when the rotor 150 is rotated. The intake groove 170 is shaped into an arcuate shape, which extends along the inner peripheral wall surface of the ring 130.

The discharge groove 190 is provided in a volume decreasing region where the volume of each corresponding pump chamber 160 decreases when the rotor 150 is rotated. Similar to the intake groove 170, the discharge groove 190 is shaped into an arcuate shape, which extends along the inner peripheral wall surface of the ring 130.

In the previously proposed vane pump 100, abrasive debris or abrasive particles are generated through sliding movement of the vanes 140 along the ring 130 and the plates 110, 120 when the rotor 150 is rotated. A majority of the abrasive particles is discharged through the outlet 200 along with the working fluid. However, as shown in FIG. 22, a fraction of the abrasive particles is accumulated in an end of the discharge groove 190, which extends from the outlet 200 in the rotational direction (a left direction in FIG. 22) of the rotor 150. Thus, when the amount of accumulated abrasive particles is increased, a portion of the accumulated abrasive particles enters an operational range of the vanes 140 beyond the discharge groove 190 and is thus scraped by the rotating vanes 140. As a result, the abrasive particles are introduced into a sliding component clearance (e.g., a clearance between the plate 120 and each vane 140), causing locking of the rotating vane pump 100.

Particularly, in a case of a pump having a small discharge rate or volume (e.g., a pump used for evaporant leakage check or vapor leakage check), a drive torque of the motor, which rotates the rotor 150, is relatively small. Thus, such a pump can be easily locked by the abrasive particles entered into the sliding component clearance. Therefore, discharge of the abrasive particles from the pump need to be performed in a reliable manner.

SUMMARY OF THE INVENTION

The present invention addresses the above disadvantage. Thus, it is an objective of the present invention to provide a vane pump capable of reducing accumulation of abrasive particles in a discharge groove of the vane pump to restrain intrusion of abrasive particles into a sliding component clearance of the vane pump.

To achieve the objective of the present invention, there is provided a vane pump that includes a housing, a rotor and a plurality of vanes. The housing includes a rotor chamber, an inlet, at least one outlet and a discharge groove. The rotor chamber is defined within the housing and has one of a circular cross section and an ellipsoidal cross section. The inlet communicates between inside and outside of the rotor chamber. The at least one outlet communicates between inside and outside of the rotor chamber. The discharge groove is recessed in the housing and is exposed to the rotor chamber to communicate between the rotor chamber and the at least one outlet. The rotor is rotatably received in the rotor chamber and has a plurality of vane grooves, which are arranged along an outer peripheral wall surface of the rotor and extend radially inwardly from the outer peripheral wall surface of the rotor. Each vane is radially reciprocably received in a corresponding one of the vane grooves of the rotor and is urged against an inner peripheral wall surface of the housing during rotation of the rotor. Each pair of adjacent vanes defines a pump chamber therebetween in a rotational direction of the rotor between the inner peripheral wall surface of the housing and the outer peripheral wall surface of the rotor. A volume of each pump chamber changes when the rotor is rotated. The inlet is communicated with each corresponding pump chamber to supply working fluid into the pump chamber when the volume of the pump chamber is increased upon rotation of the rotor. The at least one outlet is communicated with each corresponding pump chamber through the discharge groove to discharge working fluid from the pump chamber when the volume of the pump chamber is decreased upon rotation of the rotor. The discharge groove includes a first end and a second end. The second end of the discharge groove is positioned away from the first end of the discharge groove in the rotational direction of the rotor. The at least one outlet extends directly from the second end of the discharge groove.

To achieve the objective of the present invention, there is also provided a vane pump that includes a housing, a rotor and a plurality of vanes. The housing includes a rotor, an inlet, an outlet and a discharge groove. The rotor chamber is defined within the housing and has one of a circular cross section and an ellipsoidal cross section. The inlet communicates between inside and outside of the rotor chamber. The outlet communicates between inside and outside of the rotor chamber. The discharge groove is recessed in the housing and is exposed to the rotor chamber to communicate between the rotor chamber and the outlet. The rotor is rotatably received in the rotor chamber and has a plurality of vane grooves, which are arranged along an outer peripheral wall surface of the rotor and extend radially inwardly from the outer peripheral wall surface of the rotor. Each vane is radially reciprocably received in a corresponding one of the vane grooves of the rotor and is urged against an inner peripheral wall surface of the housing during rotation of the rotor. Each pair of adjacent vanes defines a pump chamber therebetween in a rotational direction of the rotor between the inner peripheral wall surface of the housing and the outer peripheral wall surface of the rotor. A volume of each pump chamber changes when the rotor is rotated. The inlet is communicated with each corresponding pump chamber to supply working fluid into the pump chamber when the volume of the pump chamber is increased upon rotation of the rotor. The outlet is communicated with each corresponding pump chamber through the discharge groove to discharge working fluid from the pump chamber when the volume of the pump chamber is decreased upon rotation of the rotor. The discharge groove includes a first end and a second end. The second end of the discharge groove is positioned away from the first end of the groove in the rotational direction of the rotor. The outlet extends generally in a direction of gravity from an intermediate point between the first end and the second end of the discharge groove. The discharge groove is sloped in the direction of gravity from both the first end and second end of the discharge groove toward the outlet.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

A first embodiment of the present invention will be described with reference to FIGS. 1 to 5B.

Figure 3:
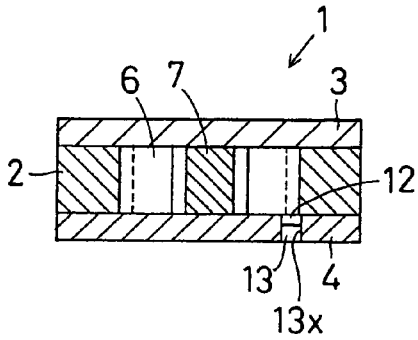
FIG. 3 is a simplified schematic axial cross sectional view of the vane pump of the first embodiment.

A vane pump 1 according to the first embodiment is used in, for example, evaporant leakage check or vapor leakage check. As shown in FIGS. 5A and 5B, first and second plates 3, 4 are arranged on opposite sides of a ring 2, and a circular rotor chamber (or alternatively, an ellipsoidal rotor chamber) 5 (FIG. 4) is defined radially inward of the ring 2. The first and second plates 3, 4 and the ring 2 cooperate together to serve as a housing of the present invention. A rotor 7, which supports a plurality of vanes 6, is rotatably received in the rotor chamber 5. A motor 8, which rotates the rotor 7, is provided. As shown in FIG. 3, the vane pump 1 is used while a rotational axis of the rotor 7 (i.e., rotational axis or shaft 8*a* of the motor 8) is oriented in the vertical direction (i.e., a top-bottom direction in FIG. 3).

Figure 4:
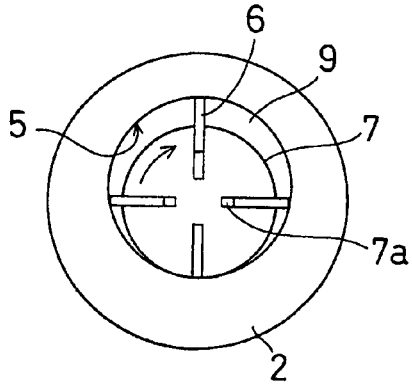
FIG. 4 is a plan view of a ring and a rotor of the vane pump of the first embodiment.
Figure 5A:
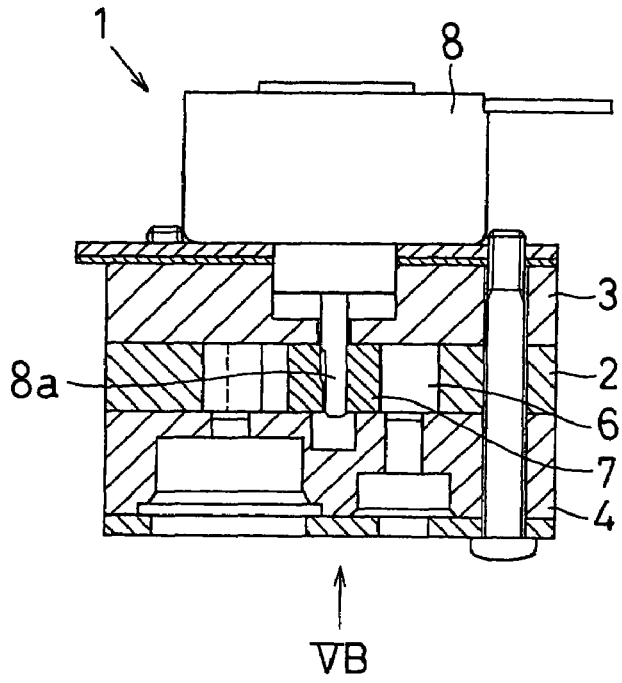
FIG. 5A is an axial cross sectional view of the vane pump of the first embodiment.
Figure 5B:
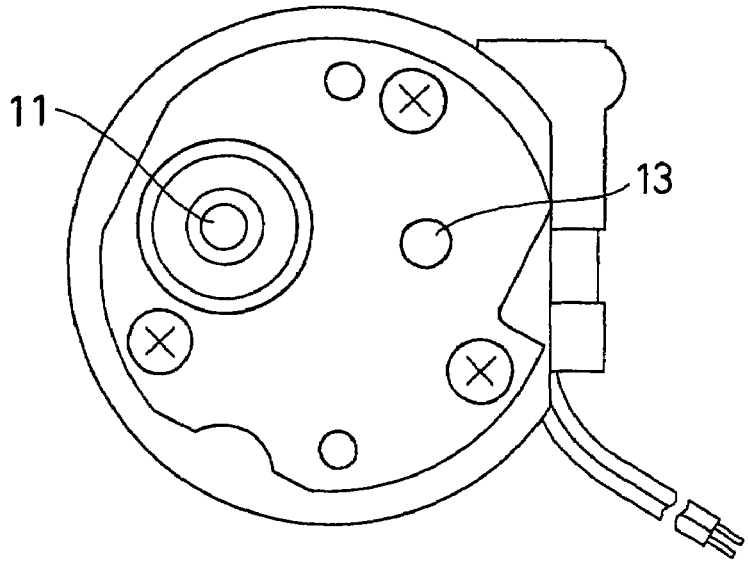
FIG. 5B is a bottom view seen from a direction of an arrow VB in FIG. 5A.

As shown in FIG. 4, an outer diameter of the rotor 7 is smaller than an inner diameter of the ring 2, and a rotational axis of the rotor 7 driven by the motor 8 is offset from the center of the rotor chamber 5. The rotor 7 has a plurality of vane grooves 7*a* (in the present embodiment, the number of vane grooves 7*a* is four, as shown in FIG. 4), which are arranged at equal intervals (90 degrees in the present embodiment) along an outer peripheral wall surface of the rotor 7. Each vane groove 7*a* extends radially inward from the outer peripheral wall surface of the rotor 7 toward the center of the rotor 7.

Each vane 6 is radially reciprocably received in a corresponding one of the vane grooves 7*a* and is radially outwardly urged by a corresponding spring (not shown), so that a radially outer end of the vane 6 abuts against an inner peripheral wall surface of the ring 2. Here, it should be noted that when a drive torque of the motor 8, which drives the rotor 7, is relatively small (i.e., when a pump capacity is relatively small), each vane 6 can be radially outwardly urged by centrifugal force without using the spring.

With the above arrangement, a plurality of pump chambers 9 (in the present embodiment, the number of the pump chambers 9 is 4, as shown in FIG. 4) is defined by the vanes 6 between the inner peripheral wall surface of the ring 2 and the outer peripheral wall surface of the rotor 7, and a volume of each pump chamber 9 changes when the rotor 7 is rotated.

Figure 1:
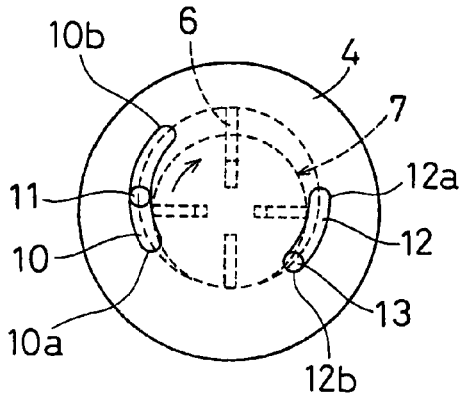
FIG. 1 is a plan view of a second plate of a vane pump of a first embodiment seen from a rotor side.
Figure 2:
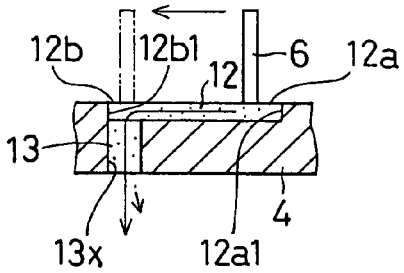
FIG. 2 is a partial cross sectional view of the second plate of FIG. 1 seen along a curved line that extends along a discharge groove of the plate.

In the second plate 4, which is placed below the ring 2, an intake groove 10, an inlet 11, a discharge groove 12 and a outlet 13 are formed, as shown in FIG. 1. Thus, as illustrated in FIGS. 2–3, the discharge groove and outlet are disoosed entirely on one axial side of the rotor chamber.

The intake groove 10 is provided in a volume increasing region where the volume of each corresponding pump chamber 9 placed in that region increases when the rotor 7 is rotated. The intake groove 10 is shaped into an arcuate shape, which extends along the inner peripheral wall surface of the ring 2. The intake groove 10 includes a first end (initial end) 10*a* and a second end (terminal end) 10*b*, and the second end 10*b* is positioned away from the first end 10*a* in a rotational direction (a direction indicated by an arrow in FIG. 1) of the rotor 7.

The discharge groove 12 is provided in a volume decreasing region where the volume of each corresponding pump chamber 9 placed in that region decreases when the rotor 7 is rotated. Similar to the intake groove 10, the discharge groove 12 is shaped into an arcuate shape, which extends along the inner peripheral wall surface of the ring 2. The discharge groove 12 includes a first end (initial end) 12*a* and a second end (terminal end) 12*b*, and the second end 12*b* is positioned away from the first end 12*a* in the rotational direction (the direction indicated by the arrow in FIG. 1) of the rotor 7. Furthermore, the discharge groove 12 includes a first end wall surface 12*a*1 and a second end wall surface 12*b*1 which are opposed to one another in the rotational direction of the rotor 7 and extend generally parallel to the rotational axis of the rotor 7, and the first end wall surface 12*a*1 is located in the first end 12*a* of the discharge groove 12, and the second end wall surface 12*b*1 is located in the second end 12*b* of the discharge groove 12.

The outlet 13 includes an inner wall surface 13*x*, which extends from the second end 12*b* of the discharge groove 12 and is generally parallel to the rotational axis of the rotor 7. The second end wall surface 12*b*1 of the discharge groove 12 is flush with one side (left side in FIG. 2) of the inner wall surface 13*x* of the outlet 13. Here, the left side of the inner wall surface 13*x* serves as a closest portion of the inner wall surface 13*x* of the outlet 13, which is closest to the second end wall surface 12*b*1 of the discharge groove 12. With this arrangement, the second end wall surface 12*b*1 of the discharge groove 12 and the one side of the inner wall surface 13*x* of the outlet 13 forms a continuous surface.

The inlet 11 is communicated with the corresponding pump chamber 9 through the intake groove 10 when the volume of the corresponding pump chamber 9 is increased, so that working fluid (in the present embodiment, the working fluid is air or gasoline vapor) is introduced into the corresponding pump chamber 9 through the inlet 11.

The outlet 13 is communicated with the corresponding pump chamber 9 through the discharge groove 12 when the volume of the corresponding pump chamber 9 is decreased, so that working fluid is discharged from the corresponding pump chamber 9 through the outlet 13.

Next, operation of the vane pump 1 will be described.

When the rotor 7 is rotated by the motor 8, the four pump chambers 9, which are defined by the vanes 6, are moved in the rotational direction of the rotor 7 and changes its volume.

This will be illustrated using one pump chamber 9.

In the process of increasing the volume of the pump chamber 9, when the pump chamber 9 is communicated with the intake groove 10, the working fluid is supplied into the pump chamber 9 from the inlet 11 through the intake groove 10.

Then, when a trailing one (i.e., one located on the trailing side in the rotational direction) of the two vanes 6, which cooperate together to define the corresponding pump chamber 9, passes the second end 10*b* of the intake groove 10, the communication between the pump chamber 9 and the intake groove 10 is disconnected to close the pump chamber 9.

Thereafter, when a leading one of the two vanes 6 passes the first end 12*a* of the discharge groove 12, the pump chamber 9 and the discharge groove 12 are communicated with each other, so that the working fluid of the pump chamber 9 is discharged from the outlet 13 through the discharge groove 12.

Advantages of the first embodiment will be described.

In the vane pump 1, when the rotor 7 is rotated, the radially outer end of each vane 6 slides along the inner peripheral wall surface of the ring 2, so that abrasive debris or particles may be generated due to the friction between the radially outer end of each vane 6 and the inner peripheral wall surface of the ring 2. The abrasive particles are included in the working fluid and is supplied into the discharge groove 12 along with the working fluid upon communication of the pump chamber 9 with the discharge groove 12. At this time, since the outlet 13 of the vane pump 1 of the present embodiment extends directly from the second end 12*b* of the discharge groove 12, the working fluid supplied into the discharge groove 12 flows in the discharge groove 12 toward the outlet 13 only in the single direction (i.e., in the rotational direction of the rotor 7).

Thus, the abrasive particles supplied into the discharge groove 12 are effectively discharged from the outlet 13 along with the working fluid without being accumulated in the second end 12*b* of the discharge groove 12, as indicated by a downwardly directed arrow in FIG. 2. In the other region of the discharge groove 12 other than the second end 12*b*, the flow of the working fluid toward the outlet 13 is created, so that the abrasive particles will be carried by the working fluid and will not be accumulated in the other region of the discharge groove 12. As a result, it is possible to restrain intrusion of the abrasive particles into the sliding component clearance, so that locking of the vane pump 1 can be prevented even if the drive torque of the motor 8 is relatively small, resulting in an increased reliability of the vane pump 1.

(Second Embodiment)

A second embodiment of the present invention will be described with reference to FIGS. 6 to 8.

Figure 6:
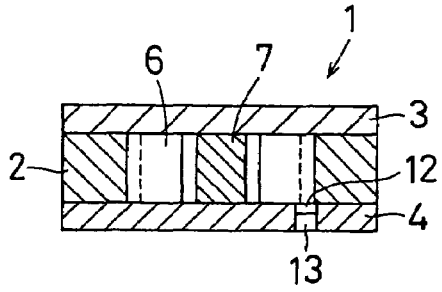
FIG. 6 is a simplified schematic cross sectional view of a vane pump of a second embodiment.
Figure 7:
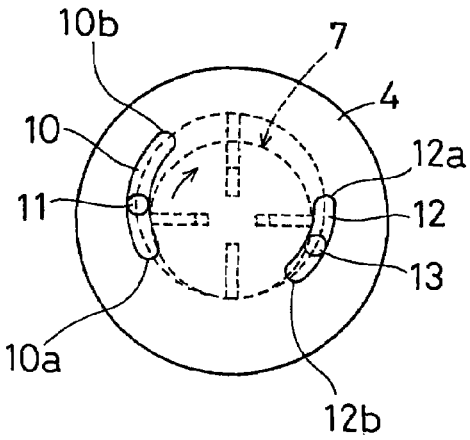
FIG. 7 is a plan view of a second plate of the vane pump of the second embodiment.

Similar to the first embodiment, the vane pump 1 of the second embodiment is used while the rotational axis of the rotor 7 is oriented in the vertical direction (i.e., a top-bottom direction in FIG. 6). The outlet 13 is positioned in an intermediate position (generally, in the center) between the first end 12*a* and the second end 12*b* of the discharge groove 12, as shown in FIG. 7.

Figure 8:
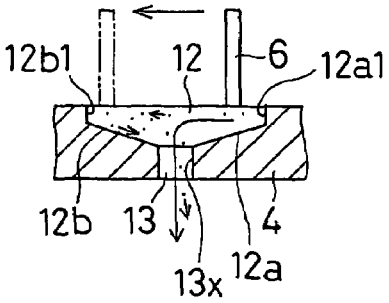
FIG. 8 is a partial cross sectional view of the second plate of the second embodiment seen along a curved line that extends along a discharge groove.

As shown in FIG. 8, a bottom surface of the discharge groove 12 is sloped in the direction of gravity (i.e., a downward direction in FIG. 8) from both the first end 12*a* and second end 12*b* toward the outlet 13.

With this arrangement, an entry of the outlet 13 is placed in the lowest point in the discharge groove 12. Thus, the abrasive particles supplied into the discharge groove 12 move downward or fall due to their own weight toward the outlet 13 and are discharged from the outlet 13. As a result, even when the abrasive particles supplied into the discharge groove 12 pass through the entry of the outlet 13 in the rotational direction of the rotor 7 and are thus supplied to the second end 12*b* of the discharge groove 12 toward the second end wall surface 12b1, the abrasive particles will not be accumulated in the discharge groove 12, and the majority of the abrasive particles will move downward or fall due to their own weight along the bottom surface of the discharge groove 12 and will be then discharged from the outlet 13.

In FIG. 8, although the first end 12*a* side of the bottom surface of the discharge groove 12 is sloped, the abrasive particles located in the first end 12*a* side of the bottom surface of the discharge groove 12 can be advantageously carried out by the flow of working fluid and thus can be discharged through the outlet 13. As a result, it is possible to provide the slope only in the second end 12*b* side of the bottom surface of the discharge groove 12 without providing the slope in the first end 12*a* side of the bottom surface of the discharge groove 12.

(Third Embodiment)

Figure 9:
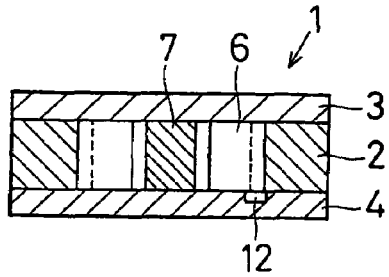
FIG. 9 is a simplified schematic axial cross sectional view of a vane pump of a third embodiment.

A third embodiment of the present invention will be described with reference to FIGS. 9 and 10.

Figure 10:
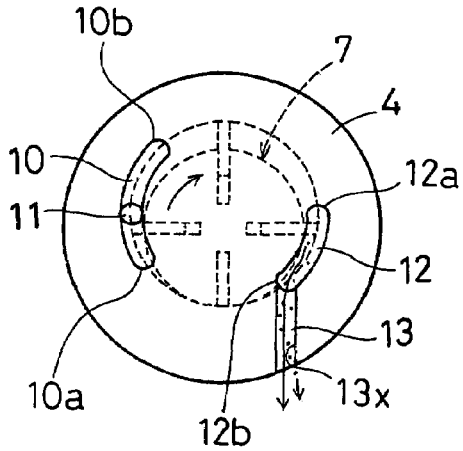
FIG. 10 is a plan view of a second plate of the vane pump of the third embodiment seen from a rotor side.

The vane pump 1 of the third embodiment is used while the rotational axis of the rotor 7 is oriented in a direction perpendicular to the vertical direction (a top-bottom direction in FIG. 10).

As shown in FIG. 10, the second end 12*b* of the discharge groove 12 is placed below the first end 12*a* of the discharge groove 12 in the vertical direction.

With this arrangement, the discharge groove 12 is used while it is generally oriented in the vertical direction, and the second end 12*b* of the discharge groove 12 is located below the first end 12*a* of the discharge groove 12. Thus, even when the rotational axis of the rotor 7 is oriented in the direction perpendicular to the vertical direction, the abrasive particles will not be accumulated in the discharge groove 12 and will be effectively discharged from the outlet 13 along with the working fluid.

(Fourth Embodiment)

Figure 11:
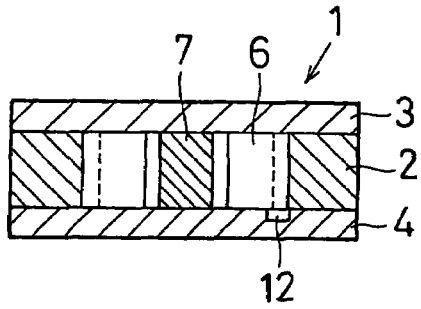
FIG. 11 is a simplified schematic axial cross sectional view of a vane pump of a fourth embodiment.

A fourth embodiment of the present invention will be described with reference to FIGS. 11 to 13.

Figure 12:
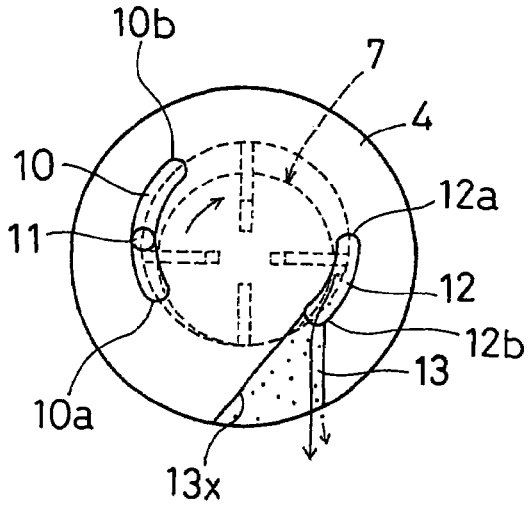
FIG. 12 is a plan view of a second plate of the fourth embodiment seen from a rotor side.

Similar to the third embodiment, the vane pump 1 of the fourth embodiment is used while the rotational axis of the rotor 7 is oriented in the direction perpendicular to the vertical direction (a top-bottom direction in FIG. 12).

Similar to the third embodiment, the second end 12*b* of the discharge groove 12 is placed below the first end 12*a* of the discharge groove 12 in the vertical direction.

As shown in FIG. 12, the outlet 13 extends from the second end 12*b* of the discharge groove 12 in the direction of gravity (a downward direction in FIG. 12), and a left side of the inner wall surface 13*x* of the outlet 13 in FIG. 12 extends in a direction that is tangent to the rotation of the rotor 7. Thus, the outlet 13 linearly diverges from the entry to the exit of the outlet 13.

With this arrangement, the working fluid is discharged in the direction that is tangent to the rotation of the rotor 7, so that the abrasive particles can be more effectively discharged from the outlet 13 along with the working fluid.

Figure 13:
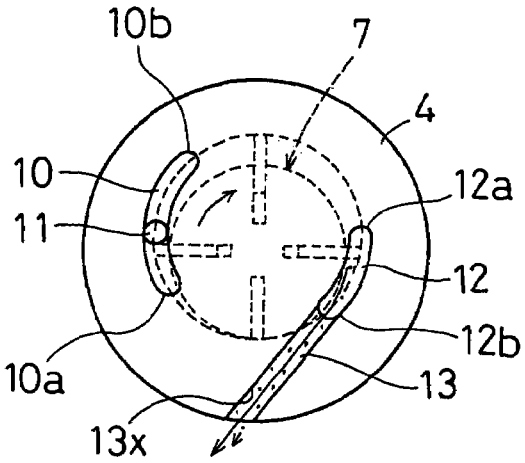
FIG. 13 is a plan view of a modification of the second plate of the fourth embodiment seen from a rotor side.

In the present embodiment, although only one side (left side in FIG. 12) of the inner wall surface 13*x* of the outlet 13 extends in the direction that is tangent to the rotation of the rotor 7, the outlet 13 can be entirely oriented in the direction that is tangent to the rotation of the rotor 7, as shown in FIG. 13.

(Fifth Embodiment)

A fifth embodiment of the present invention will be described with reference to FIGS. 14 and 15.

Figure 14:
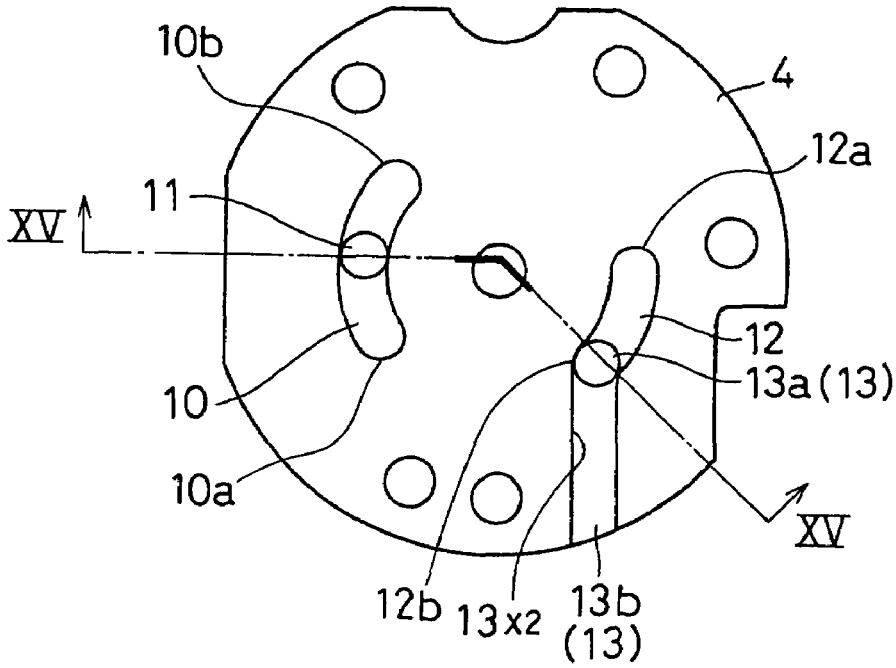
FIG. 14 is a plan view of a second plate of a vane pump of a fifth embodiment seen from a rotor side.

As shown in FIG. 14, the vane pump 1 of the fifth embodiment includes a first outlet 13*a* and a second outlet 13*b*. The first outlet 13*a* extends generally parallel to the rotational axis of the rotor 7, and the second outlet 13*b* extends generally perpendicular to the rotational axis of the rotor 7.

Figure 15:
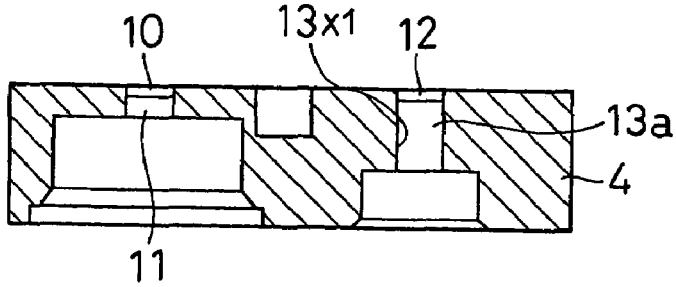
FIG. 15 is an axial cross sectional view of the second plate of the fifth embodiment along line XV-XV in FIG. 14.

With the above arrangement, the first outlet 13*a* is oriented in the direction of gravity (a downward direction in FIG. 15) from the second end 12*b* of the discharge groove 12 when the rotational axis of the rotor 7 is oriented in the vertical direction (a top-bottom direction in FIG. 15). The second outlet 13*b* is oriented in the direction of gravity (a downward direction in FIG. 14) from the second end 12*b* of the discharge groove 12 when the rotational axis of the rotor 7 is oriented in the direction perpendicular to the vertical direction (a top-bottom direction in FIG. 14).

Thus, similar to the first embodiment, when the rotational axis of the rotor 7 is oriented in the vertical direction (FIG. 15), the abrasive particles supplied into the discharge groove 12 are discharged from the first outlet 13*a* by their own weight. On the other hand, similar to the third embodiment, when the rotational axis of the rotor 7 is oriented in the direction perpendicular to the vertical direction (FIG. 14), the abrasive particles supplied into the discharge groove 12 are discharged from the second outlet 13*b* by their own weight.

In this way, in either one of the two cases, i.e., the case where the rotational axis of the rotor 7 is oriented in the vertical direction and the case where the rotational axis of the rotor 7 is oriented in the direction perpendicular to the vertical direction, the abrasive particles can be effectively discharged from the corresponding one of the first and second outlets 13*a*, 13*b*. Thus, it is possible to restrain accumulation of the abrasive particles in the discharge groove 12.

(Sixth Embodiment)

A sixth embodiment of the present invention will be described with reference to FIGS. 16 and 17.

Figure 17:
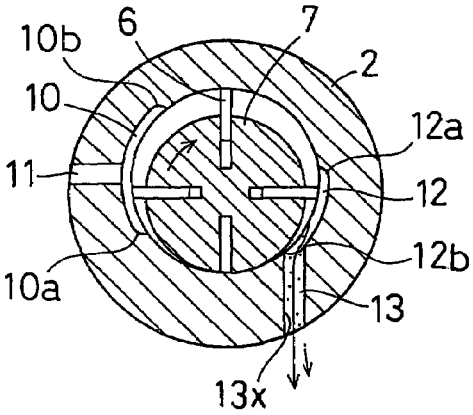
FIG. 17 is a transverse cross sectional view of the vane pump of the sixth embodiment.

The vane pump 1 of the present embodiment includes the discharge groove 12 and the outlet 13 provided in the ring 2, and the rotational axis of the rotor 7 is oriented in the direction perpendicular to the vertical direction (a top-bottom direction in FIG. 17).

Figure 16:
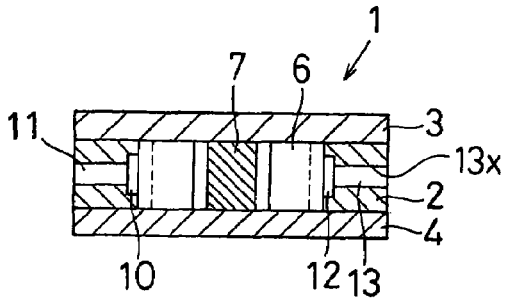
FIG. 16 is a simplified schematic axial cross sectional view of a vane pump of a sixth embodiment.

As shown in FIG. 17, the discharge groove 12 is recessed in the inner peripheral wall surface of the ring 2 in an arcuate form, and the outlet 13 is oriented in the direction of gravity (a downward direction in FIG. 17) from the second end 12*b* of the discharge groove 12 and extends all the way to the outer peripheral wall surface of the ring 2 (FIG. 16).

Even with this arrangement, the advantages similar to those of the third embodiment can be achieved.

Furthermore, the above-described arrangement of the present embodiment is applicable to the arrangement of the fourth embodiment.

Also, in the case where the rotational axis of the rotor 7 is oriented in the vertical direction (e.g., in the case of the first embodiment or second embodiment), the outlet 13 may be provided in both of the ring 2 and the second plate 4.

Modifications of the above embodiments will be described.

In the first embodiment, the second end wall surface 12b1 of the discharge groove 12 is flush with the one side (the left side in FIG. 2) of the inner wall surface 13*x* of the outlet 13. This arrangement can be modified as follows.

Figure 18:
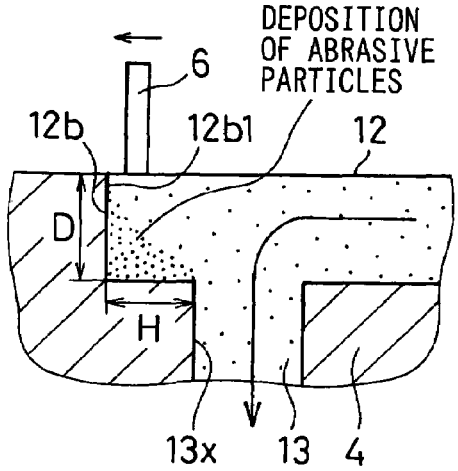
FIG. 18 is an enlarged partial cross sectional view showing a first modification of the first embodiment.

With reference to FIG. 18, in the first modification, the second end wall surface 12b1 of the discharge groove 12 is spaced away from the closest portion (a left side in FIG. 18) of the inner wall surface 13*x* of the outlet 13, which is closest to the second end wall surface 12*b*1 of the discharge groove 12 and extends generally parallel to the rotational axis of the rotor 7, in the rotational direction (a left direction in FIG. 18) of the rotor 7. A distance H between the second end wall surface 12*b*1 of the discharge groove 12 and the closest portion of the inner wall surface 13*x* of the outlet 13 in the rotational direction of the rotor is equal to or smaller than an axial extent D of the second end wall surface 12*b*1 of the discharge groove 12 in the direction generally parallel to the rotational axis of the rotor 7.

Figure 22:
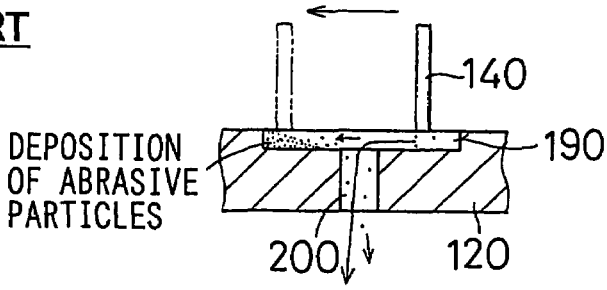
FIG. 22 RELATED ART
FIG. 22 is a partial cross sectional view of the second plate of the previously proposed vane pump seen along a curved line that extends along a discharge groove of the plate.

In this arrangement, deposition of abrasive particles could take a place in the second end 2*b* side part of the bottom surface of the discharge groove 12, which is located between the outlet 13 and the second end wall surface 12*b*1 of the discharge groove 12, as shown in FIG. 18. However, it should be noted that the deposition of the abrasive particles in the second end 2*b* side part of the bottom surface of the discharge groove 12 is caused by forces, such as intermolecular force between the abrasive particles, frictional force between the abrasive particles, surface tension of the working fluid, intermolecular force between the abrasive particles and the material of the housing (i.e., the first and second plates 3, 4 and the ring 2) and frictional force between the abrasive particles and the material of the housing. That is, in general, the horizontal deposition force, which causes deposition of the abrasive particles from the second end surface 12*b*1 of the discharge groove 12 in the right direction in FIG. 18, is substantially the same as the vertical deposition force, which causes deposition of the abrasive particles from the bottom surface of the discharge groove 12 in the upward direction in FIG. 18. Thus, a horizontal deposition extent of the abrasive particles in the horizontal direction is substantially the same as a vertical deposition extent of the abrasive particles in the vertical direction. As a result, when the distance H between the second end wall surface 12*b*1 of the discharge groove 12 and the closest portion of the inner wall surface 13*x* of the outlet 13 is greater than the axial extent D of the second end wall surface 12*b*1 of the discharge groove 12 as in the case of the previously proposed vane pump 100 shown in FIG. 22, the abrasive particles can be deposited vertically along the second end wall surface 12*b*1 beyond the discharge groove 12 into the operational range of the vanes 6 before the deposition of the abrasive particles from the second end wall surface 12*b*1 in the horizontal direction reaches the outlet 13. However, in the above modification of the first embodiment, as described above, the distance H between the second end wall surface 12*b*1 of the discharge groove 12 and the closest portion of the inner wall surface 13*x* of the outlet 13 is equal to or smaller than the axial extent D of the second end wall surface 12*b*1 of the discharge groove 12. Thus, the abrasive particles deposited from the second end wall surface 12*b*1 in the horizontal direction will fall into the outlet 13 before the abrasive particles deposited vertically along the second end wall surface 12*b*1 reaches the operational range of the vanes 6 beyond the discharge groove 12, and thus the abrasive particles deposited vertically along the second end wall surface 12*b*1 will not reach the operational range of the vanes 6 beyond the discharge groove 12. Therefore, it is possible to prevent deposition of the abrasive particles deposited vertically along the second end wall surface 12*b*1 beyond the discharge groove 12, and thus it is possible to restrain intrusion of the abrasive particles into the sliding component clearance.

Figure 19:
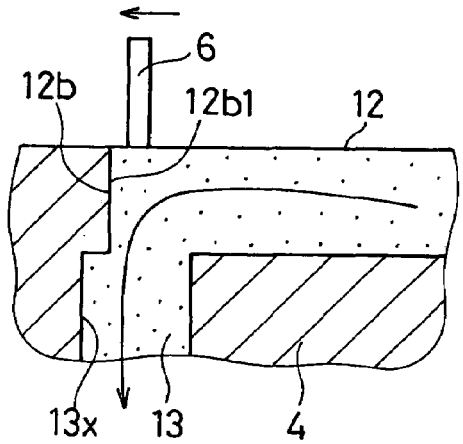
FIG. 19 is an enlarged partial cross sectional view showing a second modification of the first embodiment.
Figure 20:
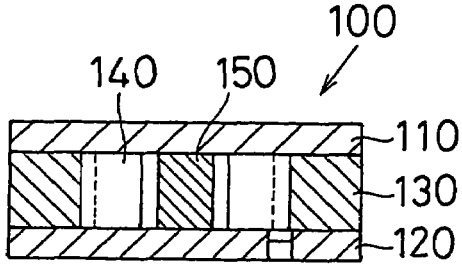
FIG. 20 RELATED ART
FIG. 20 is a simplified schematic axial cross sectional view of a previously proposed vane pump.
Figure 21:
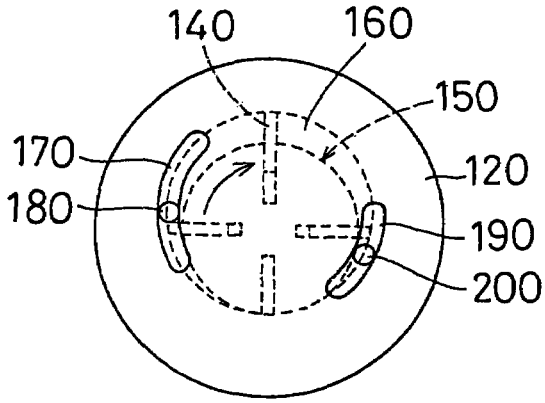
FIG. 21 RELATED ART
FIG. 21 is a plan view of a second plate of the previously proposed vane pump.

A second modification of the first embodiment will be described with reference to FIG. 19. In the second modification of the first embodiment, the closest portion (a left side in FIG. 19) of the inner wall surface 13*x* of the outlet 13, which is closest to the second end wall surface 12*b*1 of the discharge groove 12 and extend generally parallel to the rotational axis of the rotor 7, is spaced away from the second end wall surface 12*b*1 of the discharge groove 12 in the rotational direction (a left direction in FIG. 19) of the rotor 7. With this arrangement, no bottom surface of the discharge groove 12 exists on the left side of the outlet 13 in FIG. 13. Thus, similar to the first embodiment, abrasive particles will not be deposited on the left side of the outlet 13.

Additional advantages and modifications will readily occur to those skilled in the art. The invention in its broader terms is therefore not limited to the above specific details.

What is claimed is:

1. A vane pump comprising:

a housing that includes:

a rotor chamber that is defined within the housing and has one of a circular cross section and an ellipsoidal cross section;

an inlet that communicates between inside and outside of the rotor chamber;

at least one outlet that communicates between inside and outside of the rotor chamber; and a discharge groove that is recessed in the housing and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove;

the discharge groove includes a first end wall surface and a second end wall surface which are opposed to one another in the rotational direction of the rotor and extend generally parallel to a rotational axis of the rotor, wherein the first end wall surface is located in the first end of the discharge groove, and the second end wall surface is located in the second end of the discharge groove;

the outlet includes an inner wall surface, which extends from the second end of the discharge groove and is generally parallel to the rotational axis of the rotor;

the second end wall surface of the discharge groove is flush with a closest portion of the inner wall surface of the outlet, which is closest to the second end wall surface of the discharge groove; and the discharge groove and the at least one outlet are disposed entirely on one axial side of the rotor chamber.

2. The vane pump according to claim 1, wherein at least a portion of the discharge groove and at least a portion of each of the at least one outlet are located radially outward of a sliding surface portion of the inner peripheral wall surface of the housing, along which the plurality of vanes is slid.

3. The vane pump according to claim 1, wherein at least one outlet extends in a direction that is generally parallel to the rotational axis of the rotor.

4. A vane pump comprising:

a housing that includes:

a rotor chamber that is defined within the housing and has one of a circular cross section and an ellipsoidal cross section;

an inlet that communicates between inside and outside of the rotor chamber;

at least one outlet that communicates between inside and outside of the rotor chamber; and a discharge groove that is recessed in the housing and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove;

the discharge groove includes a first end wall surface and a second end wall surface which are opposed to one another in the rotational direction of the rotor and extend generally parallel to a rotational axis of the rotor, wherein the first end wall surface is located in the first end of the discharge groove, and the second end wall surface is located in the second end of the discharge groove;

the outlet includes an inner wall surface, which extends from the second end of the discharge groove and is generally parallel to the rotational axis of the rotor;

the second end wall surface of the discharge groove is spaced away from a closest portion of the inner wall surface of the outlet, which is closest to the second end wall surface of the discharge groove, in the rotational direction of the rotor; and a distance between the second end wall surface of the discharge groove and the closest portion of the inner wall surface of the outlet in the rotational direction of the rotor is equal to or smaller than an axial extent of the second end wall surface of the discharge groove in the direction generally parallel to the rotational axis of the rotor.

5. The vane pump according to claim 4, wherein the discharge groove and the at least one outlet are disposed entirely on one axial side of the plurality of vanes.

6. A vane pump comprising:

a housing that includes:

a rotor chamber that is defined within the housing and has one of a circular cross section and an ellipsoidal cross section;

an inlet that communicates between inside and outside of the rotor chamber;

at least one outlet that communicates between inside and outside of the rotor chamber; and a discharge groove that is recessed in the housing and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove;

the discharge groove includes a first end wall surface and a second end wall surface which are opposed to one another in the rotational direction of the rotor and extend generally parallel to a rotational axis of the rotor, wherein the first end wall surface is located in the first end of the discharge groove, and the second end wall surface is located in the second end of the discharge groove;

the outlet includes an inner wall surface, which extends from the second end of the discharge groove and is generally parallel to the rotational axis of the rotor; and a closest portion of the inner wall surface of the outlet, which is closest to the second end wall surface of the discharge groove is spaced away from the second end wall surface of the discharge groove in the rotational direction of the rotor that a step is defined between the closest portion of the inner wall surface of the outlet and the second end wall surface of the discharge groove.

7. A vane pump comprising:

a housing that includes:

a rotor chamber that is defined within the housing and has one of a circular cross section and an ellipsoidal cross section;

an inlet that communicates between inside and outside of the rotor chamber;

at least one outlet that communicates between inside and outside of the rotor chamber; and a discharge groove that is recessed in the housing and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove;

upon installation of the vane pump, the second end of the discharge groove is placed below the first end of the discharge groove in a vertical direction, and the outlet is oriented generally in the direction of gravity; and the outlet includes an inner wall surface, and at least a portion of the inner wall surface of the outlet extends in a direction that is tangent to rotation of the rotor.

8. A vane pump comprising:

a housing that includes:

a rotor chamber that is defined within the housing and has one of a circular cross section and an ellipsoidal cross section;

an inlet that communicates between inside and outside of the rotor chamber;

at least one outlet that communicates between inside and outside of the rotor chamber; and a discharge groove that is recessed in the housing and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove;

the at least one outlet includes first and second outlets;

the first outlet extends generally parallel to a rotational axis of the rotor;

the second outlet extends generally perpendicular to the rotational axis of the rotor; and the discharge groove and the at least one outlet are disposed entirely on one axial side of the rotor chamber.

9. A vane pump comprising: a housing that includes a ring and first and second plates, wherein the first and second plates are engaged with first and second axial ends, respectively, of the ring, and the ring includes:

a rotor chamber that is defined radially inward of the ring and has one of a circular cross section and an ellipsoidal cross section;

an inlet that communicates between inside and outside of the rotor chamber;

at least one outlet that communicates between inside and outside of the rotor chamber; and a discharge groove that is recessed in the ring and is exposed to the rotor chamber to communicate between the rotor chamber and the at least one outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the ring during rotation of the rotor, wherein:

each pair of adjacent vanes defines a pump chamber therebetween in a rotational direction of the rotor between the inner peripheral wall surface of the ring and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the at least one outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the discharge groove in the rotational direction of the rotor; and the at least one outlet extends directly from the second end of the discharge groove in a direction that is tangent to rotation of the rotor.

10. A vane pump comprising:

a housing that includes:

a rotor chamber that is defined within the housing and has one of a circular cross section and an ellipsoidal cross section;

an inlet that communicates between inside and outside of the rotor chamber;

an outlet that communicates between inside and outside of the rotor chamber; and a discharge groove that is recessed in the housing and is exposed to the rotor chamber to communicate between the rotor chamber and the outlet;

a rotor that is rotatably received in the rotor chamber and has a plurality of vane grooves, which are arranged along an outer peripheral wall surface of the rotor and extend radially inwardly from the outer peripheral wall surface of the rotor; and a plurality of vanes, each of which is radially reciprocably received in a corresponding one of the vane grooves of the rotor and is urged against an inner peripheral wall surface of the housing during rotation of the rotor, wherein:

each pair of adjacent vanes defines a pump chamber therebetween in a rotational direction of the rotor between the inner peripheral wall surface of the housing and the outer peripheral wall surface of the rotor;

a volume of each pump chamber changes when the rotor is rotated;

the inlet is communicated with each corresponding pump chamber to supply working fluid into the pump chamber when the volume of the pump chamber is increased upon rotation of the rotor;

the outlet is communicated with each corresponding pump chamber through the discharge groove to discharge working fluid from the pump chamber when the volume of the pump chamber is decreased upon rotation of the rotor;

the discharge groove includes a first end and a second end, wherein the second end of the discharge groove is positioned away from the first end of the groove in the rotational direction of the rotor;

the outlet extends generally in a direction of gravity from an intermediate point between the first end and the second end of the discharge groove; and the discharge groove is sloped in the direction of gravity from both the first end and second end of the discharge groove toward the outlet.

11. The vane pump according to claim 10, wherein the vane pump is constructed to be used in such a manner that a rotational axis of the rotor is oriented in a vertical direction, so that the discharge groove is sloped in the direction of gravity from both the first end and second end of the discharge groove toward the outlet.

12. The vane pump according to claim 10, wherein the discharge groove and the outlet are disposed entirely on one axial side of the plurality of vanes.

* * * * *